US007866942B2

(12) United States Patent
Harvie

(10) Patent No.: US 7,866,942 B2
(45) Date of Patent: Jan. 11, 2011

(54) DRY RUNNING FLEXIBLE IMPELLER PUMP AND METHOD OF MANUFACTURE

(76) Inventor: Mark R. Harvie, 1150 Airport Dr., South Burlington, VT (US) 05403

( * ) Notice: Subject to any disclaimer, the term of this patent is extended or adjusted under 35 U.S.C. 154(b) by 1028 days.

(21) Appl. No.: 11/655,663

(22) Filed: Jan. 19, 2007

(65) Prior Publication Data

US 2007/0177972 A1 Aug. 2, 2007

(51) Int. Cl.
*F04C 5/00* (2006.01)
*F01D 5/02* (2006.01)

(52) U.S. Cl. ..... 415/141; 415/200; 415/216.1; 415/217.1; 416/241 A

(58) Field of Classification Search ..... 415/140, 415/141, 172.1, 173.3, 200; 416/241 A, 416/241 B, 241 R; 418/154
See application file for complete search history.

(56) References Cited

U.S. PATENT DOCUMENTS 2,455,194 A * 11/1948 Rumsey ..... 418/154
2,902,935 A * 9/1959 Dinnison et al. ..... 418/149
3,059,583 A * 10/1962 Huber ..... 417/410.3
3,829,248 A * 8/1974 Bright et al. ..... 417/410.3
5,449,280 A * 9/1995 Maki et al. ..... 418/133
5,638,600 A * 6/1997 Rao et al. ..... 29/888.02

* cited by examiner

*Primary Examiner*—Nathaniel Wiehe
(74) *Attorney, Agent, or Firm*—Eric R. Benson

(57) ABSTRACT

This invention relates to a Dry Running Flexible Impeller Pump and Method of Manufacture that is specifically designed to provide a flexible impeller pump that is capable of being run dry for extended periods of time without damaging the impeller. The pump's housing and end plates are coated with a low friction industrial coating to limit the heat of friction created by the flexible impeller while in use. Additionally the flexible impeller is cast from a pre-molding silicone substrate that contains no mold release and is cast in a mold that is treated with a low friction industrial coating and is cast without mold release. Once the flexible impeller is removed from the mold it is cleaned with alcohol, baked in a vacuum at a temperature of at least 100° C., and then coated with a Paralene N coating by vacuum deposition.

15 Claims, 2 Drawing Sheets

DRY RUNNING FLEXIBLE IMPELLER PUMP AND METHOD OF MANUFACTURE

BACKGROUND ART

A review of prior and current flexible impeller pump technologies reveal that there are no acceptable prior art Dry Running Flexible Impeller Pumps that permit a flexible impeller pump to be run dry, even for a very few seconds, without certain catastrophic failure of the pump in general and specifically the impeller. Ironically, the very applications for which flexible impeller pumps are especially suited, are generally those types of situations where a finite source of fluids are sought to be disposed of completely where the pumping process is intended to completely pump all fluid present. It is these precise situations where a user, perhaps distracted by something else, leaves the impeller pump on to do its job emptying a vessel or fluid repository and then forgets that it has been left running, then the fluid runs dry, the pump housing runs dry and the friction of the impeller against the cam of the pump housing causes an almost immediate failure of the impeller. Any one of a number of consequences may occur as a result of being run dry. The impeller blades or vanes can rip through the bead. The bead of the impeller blades or vanes may wear flat. The bead may become pitted. The blade or vane can also experience cavitation or even tear. Lastly the blade or vane bows and sets such that the bead no longer contacts the cam. Each of these in essence lead to the same result, the pump no longer works.

Flexible impeller pumps are relatively simple devices that are easy to construct and able to pump a wide range of fluids. Impeller pumps are generally self-priming and can lift fluids several feet. Other than the motor that drives the pump the pump itself has only one moving part, a flexible impeller itself.

Most flexible impellers are molded from either neoprene or nitrile rubber with blades or vanes arranged around a hub. The end of each blade or vane has a bead, a somewhat rounded or fattened end opposite the hub. The impellers with few blades and small-diameter hubs are used to provide low-pressure, high-volume pumping capacity. Impellers with more blades or vanes and bigger hubs are used to provide lower-volume and higher-pressure pumping.

The flexible impellers are mounted inside a hollow housing that is mostly circular. A portion of this housing is indented forming a cam. The shaft of a drive motor is keyed into the hub of the flexible impeller such that when the pump's drive motor is turned on the flexible impeller will turn inside the pump's housing. As the impeller turns in the housing each blade is flexed in the cam area of the pump housing and as the impeller turns and eventually leaves the cam each blade straightens and increases the volume of the cavity formed between it and the next blade or vane. It is this expansion that causes suction which in turn then draws in the fluid being pumped. The straightened flexible impeller continues to rotate and as it does, it carries the fluid along with it. As this same blade or vane now contacts the cam it again begins to fold and compress the volume between it and the next blade. It is this compression of the fluid that creates a pressure that forces the fluid out the discharge port. This cycle continues with each next blade providing a smooth non-pulsating flow of pumped fluid.

Flexible impeller pumps are convenient and inexpensive being designed such that the fluids being pumped act as lubrication for the pump during the process of pumping. Therein, lies the problem with current and prior art flexible impeller pumps. Since the pump requires the fluid being pumped to be present in order to remain lubricated, once the pump runs dry the friction of the impeller against the cam portion of the pump housing will cause permanent damage to the impeller within no more than 15 to 20 seconds of dry running operation.

The pump housings for impeller pumps may be made from a variety of materials. Many of the lost cost pumps have a molded-plastic housing with a stamped steel cup or liner. The macerator pumps are designed without a steel liner. The most common housings for impeller pumps, however, are machined from cast metals, usually bronze, which have circular machined cavities. The cam, which is usually arc shaped, is screwed inside the cavity as a separate piece, and a cover plate with fluid tight gasket is then screwed onto the housing.

Examples of impeller pumps are taught in several patents such as those taught by E. C. Rumsey in U.S. Pat. No. 2,455,194, Takahashi in U.S. Pat. No. 3,832,105, and McCormick in U.S. Pat. No. 4,940,402. The Rumsey and McCormick patents each describe the impellers as having weights secured to the end of each vane or blade. The weight is added to keep the end of the vane or blade in contact with the housing wall and cam area as pressure against the vanes or blades increases. In practice, however, these prior art patents teach a pump technology wherein the rotation speed of the impeller increases, fluid will begin to pass between the impeller and the housing wall limiting the effective speed and maximum operating pressure of the pump. Rumsey also teaches a slot formed in a central bore of the impeller and a mating rib formed on the shaft of the drive motor for the pump. The impeller then is placed on the shaft such that the rib on the motor's shaft fits into the slot formed in the impeller. This key configuration is intended to reduce impeller slipage on the shaft as the shaft rotates at higher speeds and pressure within the housing increase, however, the slot may begin to slip over the rib and ultimately the impeller rotates on the shaft.

Takahashi describes a pump device that includes a flexible impeller similar to the instant application wherein the impeller is sandwiched between two plates. The flexible impeller is attached to the shaft of the pump, such that the rotation axis of the flexible impeller is aligned with the rotation axis of the shaft of the pump drive motor. The plates are either rotating on a bearing surface or suspended within the housing so that a portion of the plates bore contacts the drive motor's shaft. The inner surface of the bore on which each plate rotates is especially subject to wear especially if the pump is run dry.

Maki describes in U.S. Pat. No. 6,203,302 A high pressure fluid forcing pump that has a cavity adaptable for receiving a flexible impeller assembly rotatable within the cavity of the pump housing. The flexible impeller assembly includes a flexible impeller engaged between two bearing plates and having tips fixed to the bearing plates adjacent an outer circumference of the bearing plates. Maki further teaches a flexible impeller assembly that includes a locking arrangement that ensures that the impeller rotates about the motor shaft of the pump. The motor's shaft is positioned in the cavity of the pump's housing, and the rotational axis of the shaft and impeller are offset from the longitudinal axis of the cavity and the two bearing plates. Despite its improvement over E. C. Rumsey in U.S. Pat. No. 2,455,194, Takahashi in U.S. Pat. No. 3,832,105, and McCormick in U.S. Pat. No. 4,940,402, Maki also fails to teach a flexible impeller pump that may be run dry for any more than just a few seconds without permanently damaging the impeller and/or the pump.

While each of these prior art flexible impeller pump devices fulfill their respective particular objectives and requirements, and are most likely quite functional for their intended purposes, it will be noticed that none of the prior art cited disclose an apparatus and/or method of manufacture that is capable of being run dry for extended periods of time without pump failure.

As such, there apparently still exists the need for a new and improved flexible impeller pump to maximize the benefits to the user and minimize the risks of expensive damage to the pump when it is run dry.

In this respect, the present invention disclosed herein substantially corrects these problems and fulfills the need for such a device.

DISCLOSURE OF THE INVENTION

In view of the foregoing limitations inherent in the known types of flexible impeller pumps now present in the prior art, the present invention provides an apparatus that has been designed to provide the following features for a user:

Effective non-pulsating fluid pumping

Durable and able to withstand neglect in cleaning and operation where the pump is likely to be neglected and run dry Able to be run dry for more than a thousand times longer than current technology impeller pumps Resistant to chemical agents Easy to maintain These features are improvements which are patently distinct over similar devices and methods which may already be patented or commercially available. As such, the general purpose of the present invention, which will be described subsequently in greater detail, is to provide a field designed apparatus and method of manufacture that incorporates the present invention. There are many additional novel features directed to solving problems not addressed in the prior art.

To attain this the present invention generally comprises five major components: 1) a Flexible Impeller sandwiched between; 2) two End Plates mounted to; 3) a Pump Housing to which is attached; 4) a Drive Motor Mount to which is attached; 5) a Drive Motor the shaft of which is keyed into the Flexible Impeller to rotate the Flexible Impeller within the Pump Housing and between the two End Plates. In order to reduce friction and permit the pump to be run dry the two End Plates and the Pump Housing are coated with Magnaplate HCR® (This process results in a surface dynamic coefficient of friction of 0.17) and the Flexible Impeller is cleaned with alcohol, baked at a high temperature to prepare the surface for vacuum deposition of a Paralene N (Poly Para Xylylene Polymer) coating.

These together with other objects of the invention, along with the various features of novelty which characterize the invention, will be pointed out with particularity in the claims. For a better understanding of the invention, its operating advantages and the specific objects attained by its uses, reference should be had to the accompanying drawings and descriptive matter in which there is illustrated preferred embodiments of the invention.

BEST MODES FOR CARRYING OUT THE INVENTION

I. Preferred Embodiments

Figure 1:
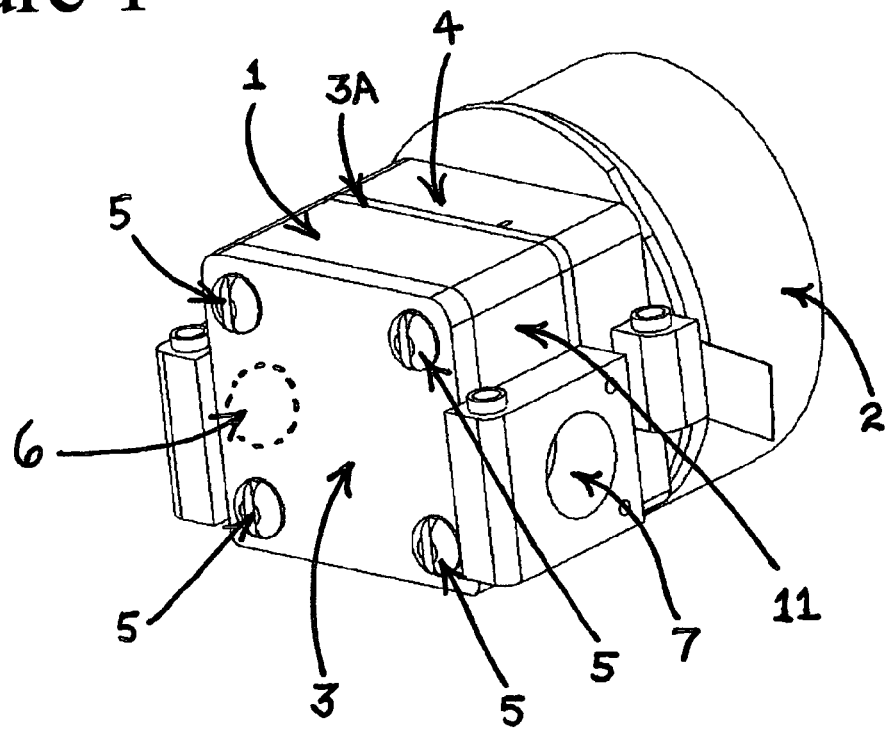
FIG. 1 is perspective view of the Dry Running Flexible Impeller Pump assembled for operation.
Figure 2:
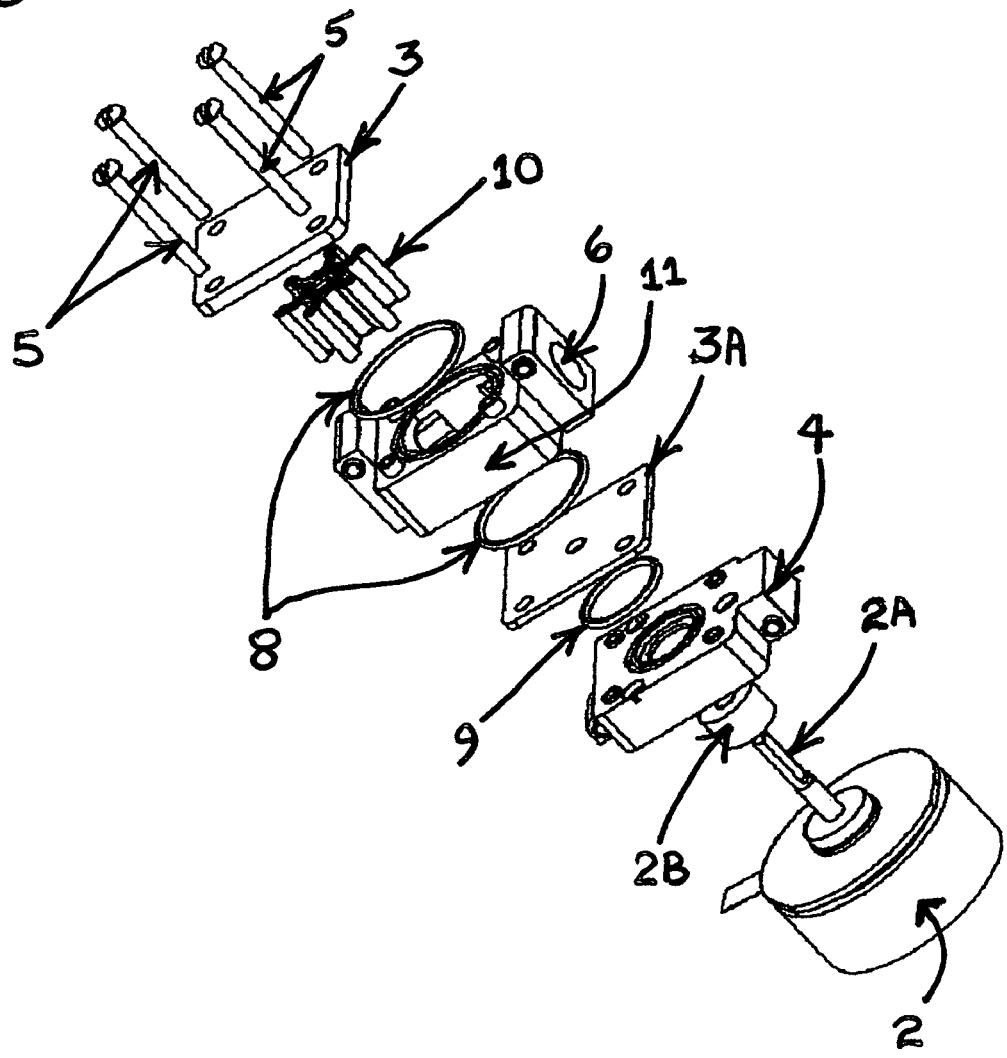
FIG. 2 is an exploded perspective view of the Dry Running Flexible Impeller Pump.

With reference now to the drawings, and in particular to FIGS. 1-2 thereof, a new and novel Dry Running Flexible Impeller Pump device embodying the principles and concepts of the present invention is depicted in these drawings as comprising five major components: 1) a Flexible Impeller (10) sandwiched between; 2) two End Plates (3) mounted to; 3) a Pump Housing (11) to which is attached; 4) a Drive Motor Mount (4) to which is attached; 5) a Drive Motor (2) the Drive Motor Shaft (2A) of which is keyed into the Flexible Impeller (10) to rotate the Flexible Impeller (10) within the Pump Housing (11) and between the two End Plates (3), and the Dry Running Flexible Impeller Pump is generally designated by the reference numeral (1).

General Description of Reference Numerals in the Description and Drawings

Any actual dimensions listed are those of the preferred embodiment. Actual dimensions or exact hardware details and means may vary in a final product or most preferred embodiment and should be considered means for so as not to narrow the claims of the patent.

LIST AND DESCRIPTION OF COMPONENT PARTS OF THE INVENTION (1) Dry Running Flexible Impeller Pump
(2) Drive Motor
(2A) Drive Motor Shaft
(2B) Drive Motor Shaft Bushing
(3) End Plate
(3A) Motor Side End Plate
(4) Drive Motor Mount
(5) Screw
(6) Intake Port
(7) Discharge Port
(8) End Plate Gasket
(9) Drive Motor Mount Gasket
(10) Flexible Impeller
(11) Pump Housing

DETAILED DESCRIPTION OF THE PREFERRED EMBODIMENTS

The most preferred embodiment of the Dry Running Flexible Impeller Pump (1) depicted in FIGS. 1 and 2 is manufactured and comprised of the following components in their respective functional relationships:

The invention accomplishes its intended purpose of producing an impeller pump that may be run dry by applying low friction industrial coatings to critical components of the Dry Running Flexible Impeller Pump. In the Most Preferred Embodiment the Pump Housing (11) and End Plates (3) are made from 6061 aluminum. They are each anodized with an industrial coating such as Magnaplate HCR® with a thickness of 0.0017"-0.0023", which produces a 50% build up and a 50% penetration in the aluminum. This process results in a surface dynamic coefficient of friction of 0.17 (HCR to HCR surface). This coating also hardens the aluminum surface to a Rockwell C hardness scale of 65. The process also improves the thermal conductivity of coated versus uncoated aluminum. In the Most Preferred Embodiment the Flexible Impeller (10) is injection molded from (LSR) Liquid Silicon Rubber or (HCR) High Compression (silicon) Rubber. It is critical to the object of this invention that the pre-molding silicone substrate that is to be molded contain no mold release compositions of any kind. It is additionally critical that the mold from which the Flexible Impeller (10) is cast will itself be coated or anodized with an industrial coating such as Magnaplate HCR®. The Flexible Impeller (10) is molded without the use of any type of mold release on the mold itself and since the mold itself has been anodized with Magnaplate HCR® the Flexible Impeller (10) is easily removed from the mold without the use of any mold release after it is cast. The absence of mold release is critical because if it were present it would contaminate the surface of the Flexible Impeller (10) and prevent the molecular bonding of a critical low friction industrial coating described below. In the Most Preferred Embodiment the Flexible Impeller (10) the low friction industrial coating is a Paralene N coating which is a polymer of Poly Para Xylylene. The Flexible Impeller (10) must then be cleaned with an alcohol and baked at a high temperature of at least 100° C. The Paralene N is applied to the cleaned and baked Flexible Impeller (10) with specialized vacuum deposition equipment that permits control of coating rate and thickness. The deposition process takes place at the molecular level as the chemical, in dimer form, is converted under vacuum and heat to dimeric gas; pyrolized to cleave the dimer; and finally deposited as a clear polymer film. The Paralene N is applied at 0.0002-in per hour with a coating thicknesses from 0.100 to 76 microns which can be applied in a single operation. The Parylene N vacuum chamber bonding to the silicon rubber of the Flexible Impeller (10) results in Flexible Impeller (10) having a coefficient of friction of 0.25.

The Drive Motor Shaft (2A) end of the Drive Motor (2) is inserted through the Drive Motor Shaft Bushing (2B), then through the central bore of the Drive Motor Mount (4), then through the Drive Motor Mount Gasket (9), then through the central bore of the Motor Side End Plate (3A), then through the End Plate Gasket (8), then through the Pump Housing (11), then through a second End Plate Gasket (8), then the end of the Drive Motor Shaft (2A) snugly fits into a tight fitting notched hole in the Flexible Impeller (10) that is cast into a shape and size capable of accepting the Drive Motor Shaft (2A) tightly within the Flexible Impeller (10) such that as the Drive Motor Shaft (2A) is turned by the Drive Motor (2) the Flexible Impeller (10) will turn with the Drive Motor Shaft (2A) not allowing the Drive Motor Shaft (2A) to spin within the cast notched hole.

The End Plate (3) is then backed up against the Flexible Impeller (10) on the opposite end of the Dry Running Flexible Impeller Pump (1) from the Drive Motor (2). Screws (5) are then inserted through mounting holes in the corners of the End Plate (3) which then pass through corresponding holes in the Pump Housing (11) the Motor Side End Plate (3A) and then are securely screwed into corresponding threaded holes tapped into the Drive Motor Mount (4) thereby creating a fluid tight seal of all the component parts as the End Plate Gaskets (8) and the Drive Motor Mount Gasket (9) are seated and sealantly engaged between the corresponding components as illustrated in FIG. 2. The Drive Motor (2) may be powered by any means required by a user, such as electricity, gas, hydraulic, or combustion engine. When power is added to the Drive Motor (2) it causes the Flexible Impeller (10) to turn within the Pump Housing (11) such that as it flexes and straightens over the internal cast cam area it creates a suction on the Intake Port (6) of the Pump Housing (11) such that it will draw into the Pump Housing (11) a user selected fluid and then discharge the fluid with pressure out the Discharge Port (7). Depending upon the required usage of the Dry Running Flexible Impeller Pump (1) by a user, intake and discharge hoses and other apparatus may be attached as needed.

While my above descriptions of the invention, its parts, manufacture and operations contains many specificities, these should not be construed as limitations on the scope of the invention, but rather as exemplifications of present embodiments thereof. Many other variations are possible, for example, other embodiments, shapes, and sizes of the device can be constructed and designed to work by the principles of the present invention; various materials, colors and configurations can be employed in the device's design that would provide interesting embodiment differences to users. It is not necessary, for example, that the pump housing and end plates be manufactured from aluminum since other suitable materials exist that will achieve the same result in practice. The pump housing and end plates could be manufactured of other metals, polymers or plastics, which in turn may be coated with low friction coatings by anodizing in the case of metals or polymerization deposition as in the case of polymers and plastics. Similarly these components could be made from ceramics, and similarly coated for low friction contact with the flexible impeller. Similarly, the flexible impeller could also be made of other materials with similar flexing characteristics such as rubber, and related polymers and rubber substitutes and Teflon. The power supply to the Drive Motor (2) may also be photovoltaic, as well as many other obvious variations.

Accordingly, the scope of the invention should be determined not by the embodiments illustrated, but by the claims and their legal equivalents which accompany this application.

Having described my invention, I claim:

1. A dry running flexible impeller pump comprised of:

a pump power means;

a pump shaft attached to the pump power means;

a pump housing into which the pump shaft is inserted;

a flexible impeller inside the pump housing and attached to the pump shaft wherein when the pump power means is activated the pump shaft thereby is caused to rotate and further cause the flexible impeller to rotate inside the pump housing;

the pump housing having an intake port and a discharge port wherein when the flexible impeller rotates inside the pump housing a suction on the intake port is created wherein a fluid may thereby be drawn into the intake port then into the pump housing and exhausted therefrom by the flexible impeller through the discharge port;

the pump housing and the flexible impeller being further comprised of a surface coating with a lower coefficient of friction than that of the pump housing or the flexible impeller respectively wherein about fifty percent of the thickness of the surface coating of the pump housing penetrates into the surface of the pump housing and the remaining surface coating forming an outer coated surface of the pump housing.

2. The dry running flexible impeller pump of claim 1 wherein the pump housing is further comprised of a power means side end plate and an end plate which are removably attached to the pump housing.

3. The dry running flexible impeller pump of claim 2 wherein the pump housing is comprised of a metal and the surface coating of the pump housing is anodized to the surface of the pump housing.

4. The dry running flexible impeller pump of claim 2 wherein the pump housing is comprised of a plastic and the surface coating of the pump housing is polymerized to the surface of the pump housing.

5. The dry running flexible impeller pump of claim 2 wherein the pump housing is comprised of a ceramic and the surface coating of the pump housing is polymerized to the surface of the pump housing.

6. The dry running flexible impeller pump of claim 1 wherein the flexible impeller is comprised of a mold cast silicon rubber wherein the silicon rubber pre-molding silicone substrate used to cast the silicon rubber flexible impeller contains no mold release compositions of any kind.

7. The dry running flexible impeller pump of claim 6 wherein the mold is comprised of a low friction surface coating anodized to the mold's surfaces that contact the flexible impeller as it is molded in the mold.

8. The dry running flexible impeller pump of claim 7 wherein the low friction surface coating anodized to the mold's surfaces is comprised of a low friction industrial coating.

9. The dry running flexible impeller pump of claim 1 wherein the surface coating of the flexible impeller is a clear polymer film deposited on the flexible impeller under vacuum and heat.

10. The dry running flexible impeller pump of claim 1 wherein the surface coating of the pump housing is comprised of a low friction industrial coating that has been anodized on the pump housing to form the surface coating.

11. The dry running flexible impeller pump of claim 1 wherein the surface coating of the flexible impeller is comprised of a polymer of Poly Para Xylylene.

12. A method of manufacturing the dry running flexible impeller pump of claim 1 comprised of the steps of:

selecting an injection mold capable of casting silicon rubber from a pre-molding silicone substrate to form the flexible impeller in a desired shape and size;

coating with a low friction compound the surfaces of the injection mold that have contact with the flexible impeller as it is being molded;

constructing the pump housing of a shape and size such that when the flexible impeller rotates inside the pump housing a suction on the intake port is created wherein a fluid may thereby be drawn into the intake port then into the pump housing and exhausted therefrom by the flexible impeller through the discharge port;

coating with a low friction compound the surfaces of the pump housing that have contact with the flexible impeller as it rotates inside the pump housing;

casting the flexible impeller in the coated mold from a pre-molding silicone substrate that contains no mold release;

removing the flexible impeller from the coated mold;

cleaning the surfaces of the flexible impeller;

heating the flexible impeller in a vacuum;

coating with a low friction compound the heated flexible impeller while under vacuum by vacuum chamber bonding deposition;

selecting a pump power means;

constructing a pump shaft capable of inserting into the pump housing and capable of attaching to the flexible impeller and the pump power means;

assembling the dry running flexible impeller pump by attaching the pump power means to the pump shaft which pump shall is inserted into the pump housing and the pump shaft is then attached to the flexible impeller which is rotatably disposed inside the pump housing such that when pump power means is engaged the pump shaft turns inside the pump housing thereby causing the flexible impeller to rotate inside the pump housing causing a suction thereby on the intake port is created wherein a fluid may thereby be drawn into the intake port by the suction and the fluid then enters into the pump housing and is exhausted therefrom by the flexible impeller through the discharge port.

13. The method of manufacturing the dry running flexible impeller pump of claim 12 wherein:

the coating with a low friction compound the surfaces of the injection mold that have contact with the flexible impeller as it is being molded is comprised of anodizing the surfaces with a low friction industrial coating.

14. The method of manufacturing the dry running flexible impeller pump of claim 12 wherein:

the coating with a low friction compound the surfaces of the pump housing that have contact with the flexible impeller as it rotates inside the pump housing is comprised of anodizing the surfaces with a low friction industrial coating.

15. The method of manufacturing the dry running flexible impeller pump of claim 12 wherein:

the coating with a low friction compound of the heated flexible impeller while under vacuum by vacuum chamber bonding deposition is comprised of a polymer of Poly Para Xylylene.

* * * * *